US005339068A

United States Patent [19]

Tsunoda et al.

[11] Patent Number: 5,339,068

[45] Date of Patent: Aug. 16, 1994

[54] CONDUCTIVE CHIP-TYPE CERAMIC ELEMENT AND METHOD OF MANUFACTURE THEREOF

[75] Inventors: Masakiyo Tsunoda; Hiroaki Nakajima; Masami Koshimura, all of Saitama, Japan

[73] Assignee: Mitsubishi Materials Corp., Tokyo, Japan

[21] Appl. No.: 79,347

[22] Filed: Jun. 18, 1993

[30] Foreign Application Priority Data

Dec. 18, 1992 [JP] Japan ..... 4-356128
Apr. 7, 1993 [JP] Japan ..... 5-080471

[51] Int. Cl.[5] ..... H01C 1/148

[52] U.S. Cl. ..... 338/332; 338/308; 338/324

[58] Field of Search ..... 338/308, 332, 327, 227

[56] References Cited

U.S. PATENT DOCUMENTS 4,780,702 10/1988 Snel et al. ..... 338/308
4,924,205 5/1990 Caporali et al. ..... 338/227
4,984,130 1/1991 Düll et al. ..... 338/327 X
4,992,771 2/1991 Caporali et al. ..... 338/22 R
5,111,117 5/1992 Flassayer et al. ..... 339/313

*Primary Examiner*—Marvin M. Lateef
*Attorney, Agent, or Firm*—Peter J. Gluck; Thomas R. Morrison; Vincent Kohli

[57] ABSTRACT

A chip-type ceramic element contains a terminal electrode at each end and an inorganic insulating layer on the surface of the ceramic element between the electrodes. The terminal electrodes include a baked electrode formed from a conductive paste reacted with the material of the inorganic insulating layer. Layers of nickel and tin are plated on the baked electrode for improved heat resistance and soldering adhesion, respectively. The insulating layer prevents unwanted portions of the terminal electrodes from coming into contact with the ceramic element, thereby preventing dispersion in the resistance values of the element.

38 Claims, 14 Drawing Sheets

FIG. 1
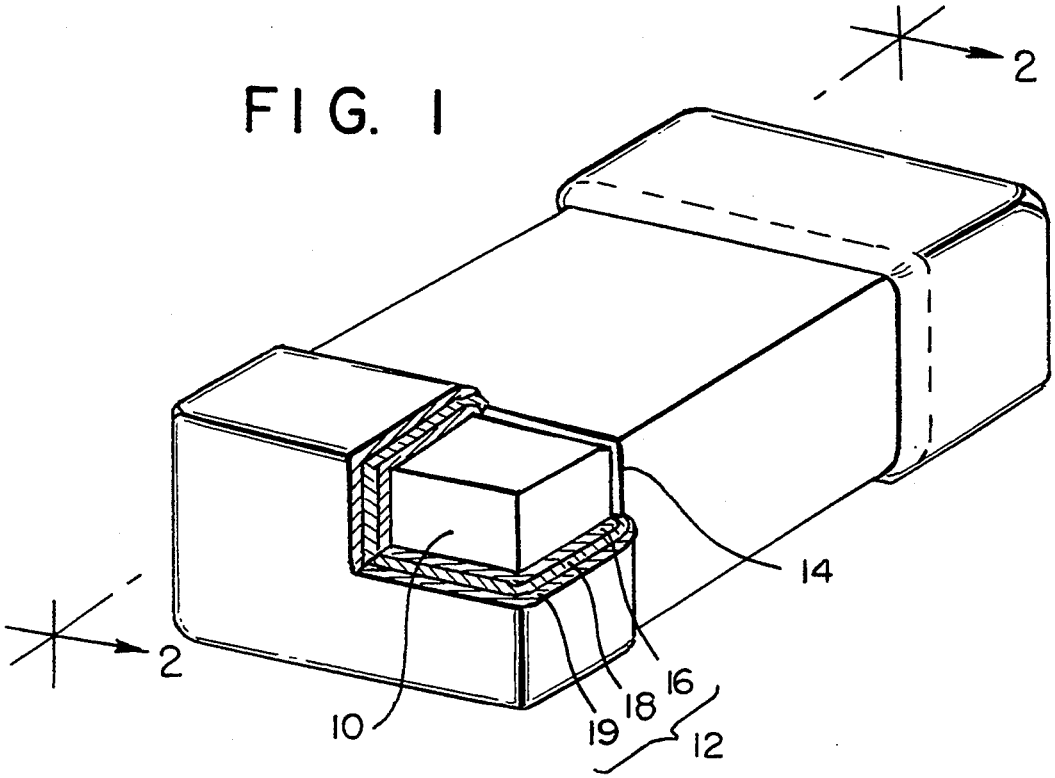
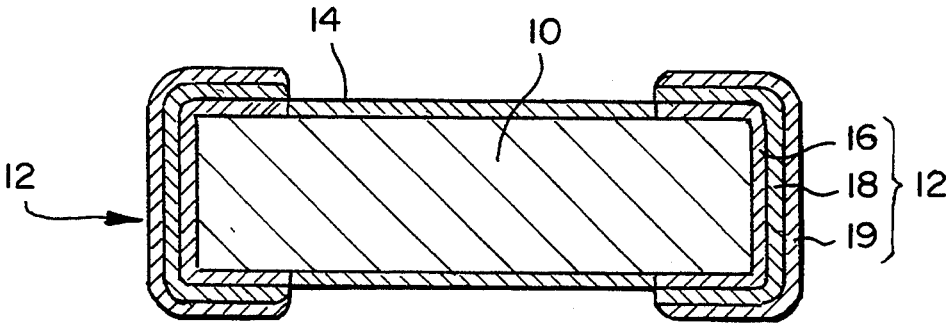
FIG. 2

FIG. 8
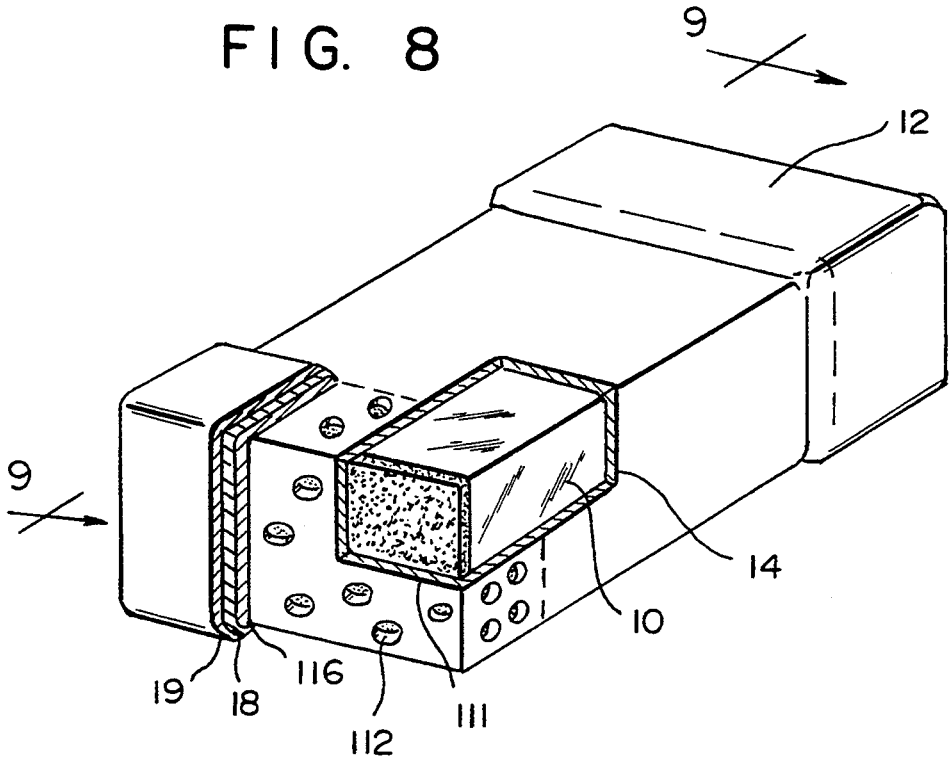
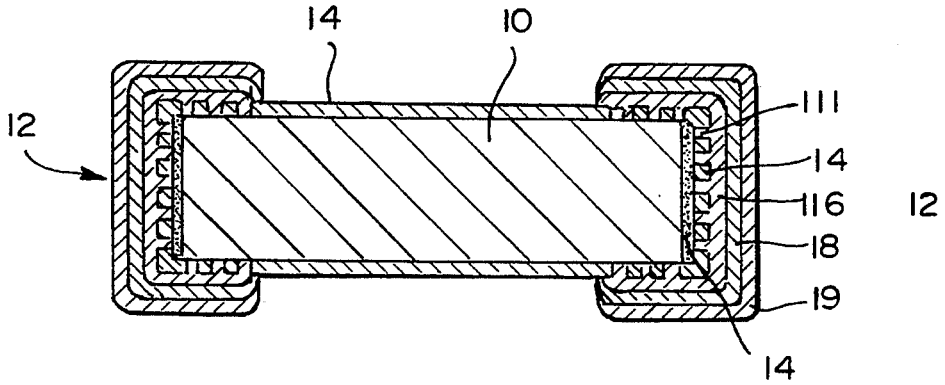
FIG. 9

FIG. 10a
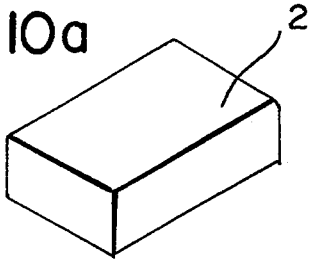
FIG. 10b
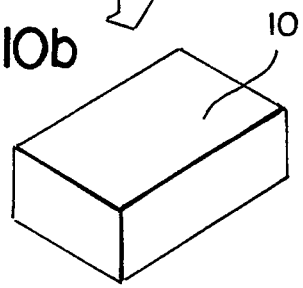
FIG. 10c
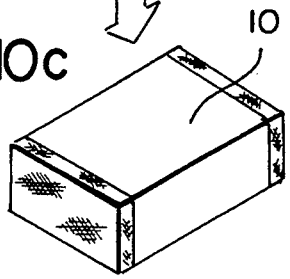
FIG. 10d
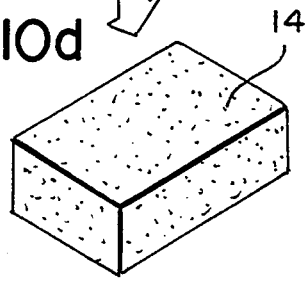
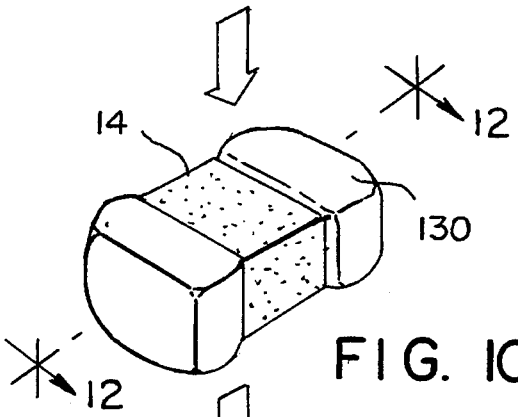
FIG. 10e
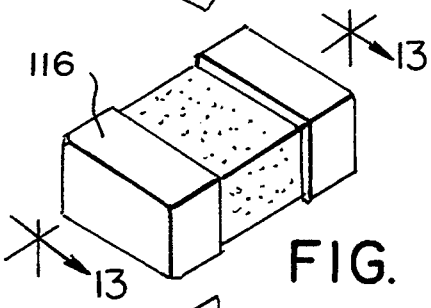
FIG. 10f
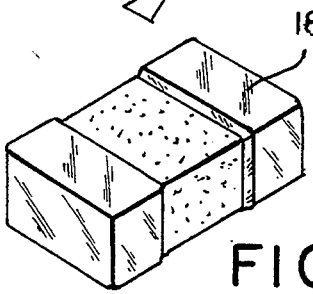
FIG. 10g
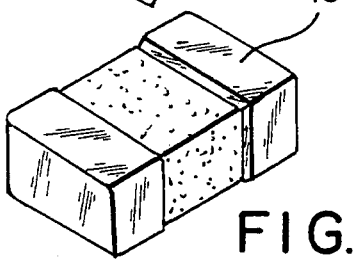
FIG. 10h FIG. 12
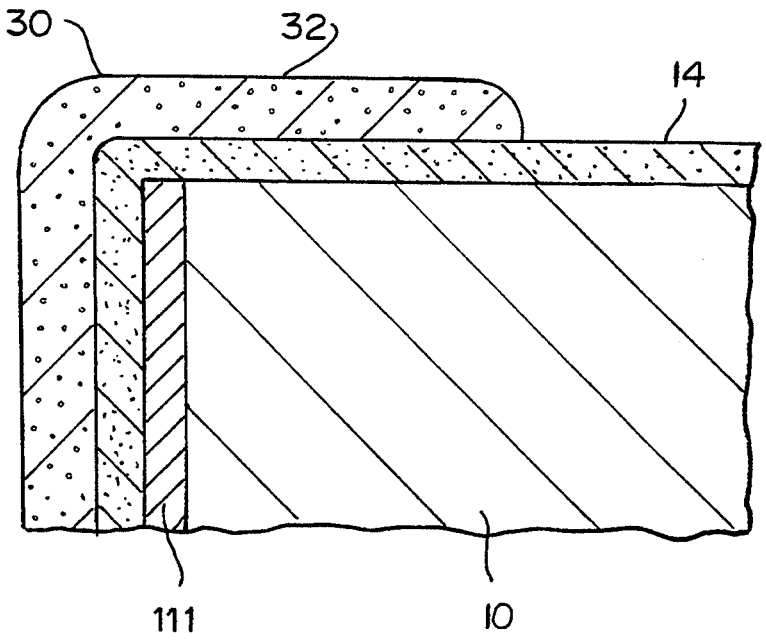
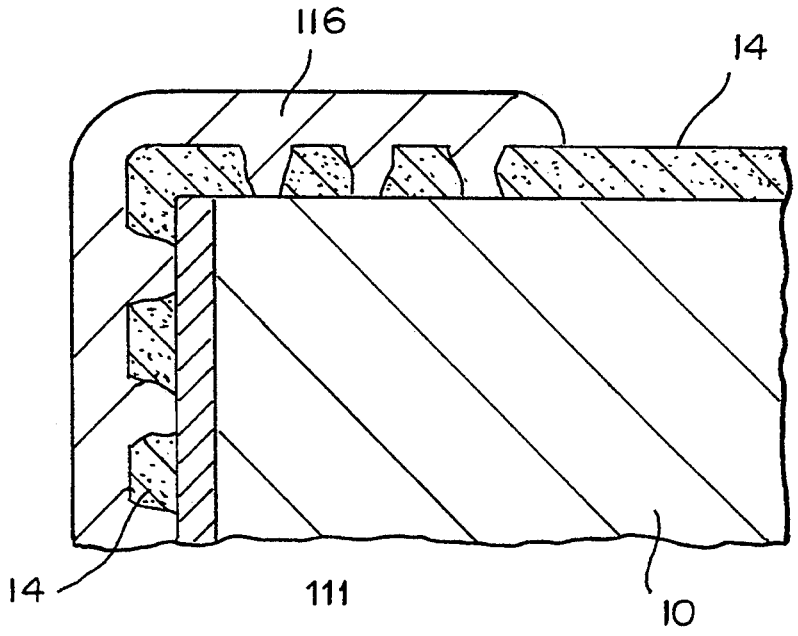
FIG. 13

FIG. 14
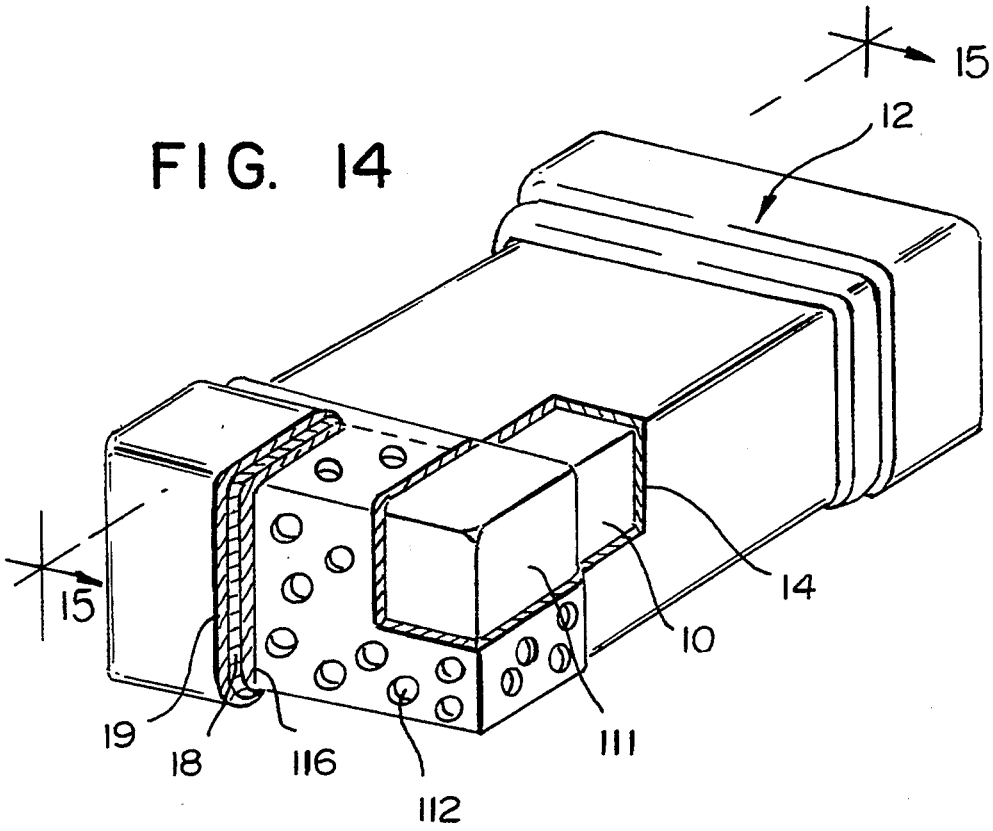
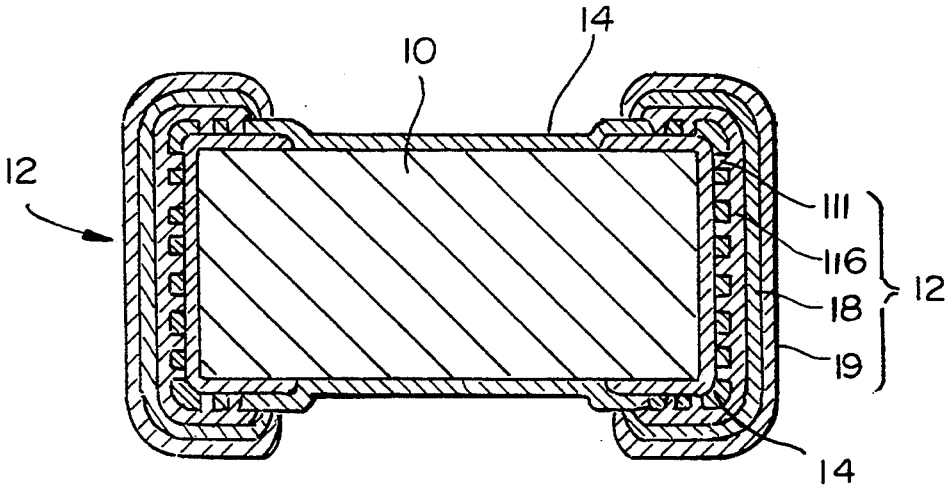
FIG. 15

FIG. 16a
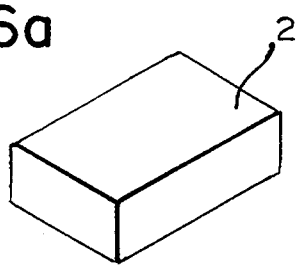
FIG. 16b
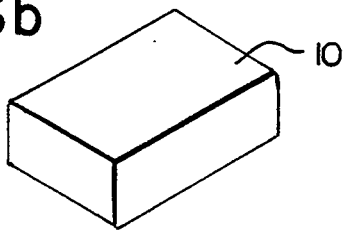
FIG. 16c
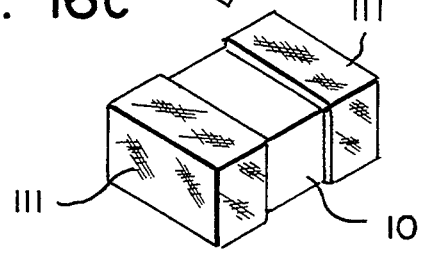
FIG. 16d
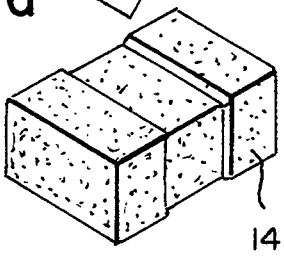
FIG. 16e
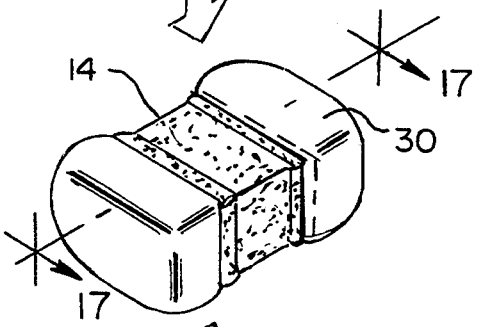
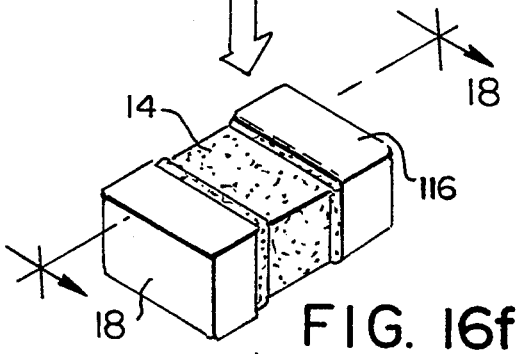
FIG. 16f
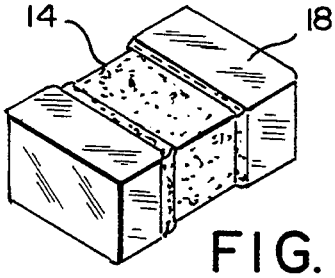
FIG. 16g
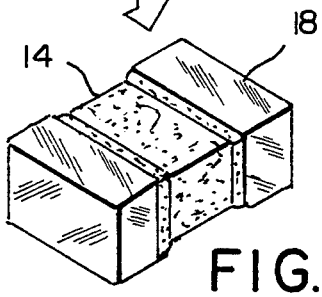
FIG. 16h FIG. 17
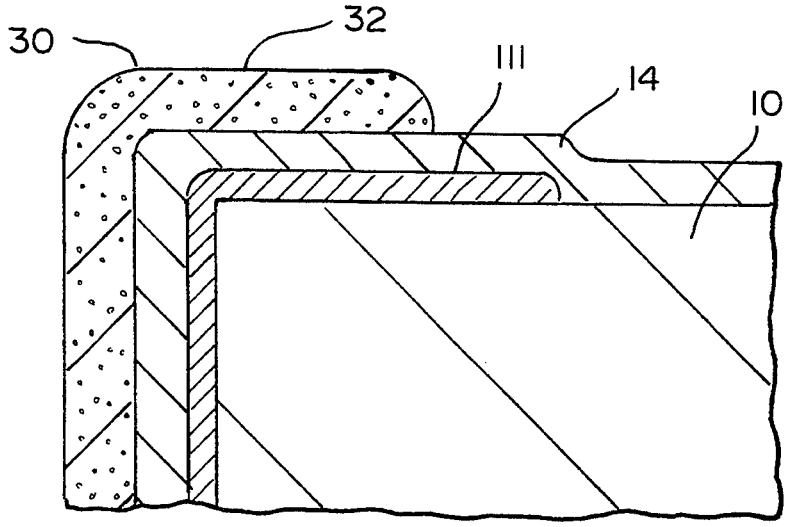
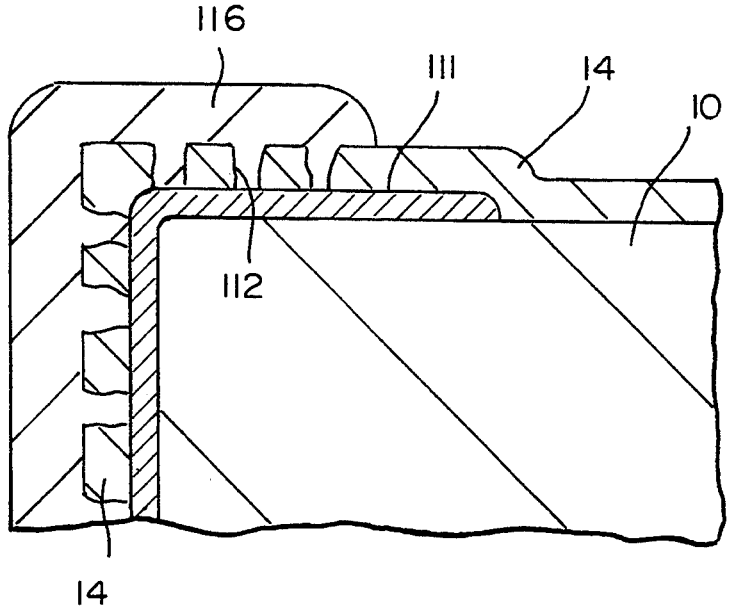
FIG. 18

CONDUCTIVE CHIP-TYPE CERAMIC ELEMENT AND METHOD OF MANUFACTURE THEREOF

BACKGROUND OF THE INVENTION

The present invention relates to a conductive ceramic element and, more particularly, to a ceramic element with terminal electrodes having a baked electrode layer, and an insulating inorganic layer encapsulating the surface of the ceramic body between the terminal electrodes.

A conductive chip-type ceramic element according to the prior art includes a ceramic body having silver-palladium electrodes fused at both ends thereof. The palladium imparts soldering heat resistance to the electrode, thereby preventing the silver from dissolving when soldering a chip-type thermistor to a substrate.

A drawback of the prior art is that the terminal electrode is manufactured by dipping the ends of the ceramic body into a silver-palladium paste. Regardless of the level of control exercised during the dipping process, however, dispersion of the material of the electrode near the edges of the thermistor body is inevitable. This produces a dispersion in the part-to-part resistance values of the resulting elements.

A further drawback of the prior art is that the increased palladium content causes a decrease in the solder adhesion of the electrode to the substrate, thereby establishing an upper limit on the amount of palladium which can be used. When soldering an electrode at high temperature for a long period of time, however, this upper limit provides insufficient palladium to impart adequate soldering heat resistance to the electrode.

It has been suggested that soldering heat resistance and soldering adhesion can be improved by providing a plating layer on the surface of the electrodes, as in the case of a chip-type capacitor. A drawback of this suggestion is that since the ceramic body of a thermistor is conductive (unlike the ceramic body of a capacitor), plating a conductive material directly on the surface of the ceramic body alters the resistance value of the ceramic element from the desired value. In addition, a portion of the ceramic is eroded by the plating liquid, thereby reducing the life and reliability of the ceramic element.

To overcome the above drawbacks, Applicant has filed Japanese Laid-Open Patent Publication No. 3-250,603, laid open in 1991, for a chip-type thermistor shown in FIG. 19. A ceramic body 10 is covered by a glass layer 4 and a baked electrode 16. A plated layer 3 covers baked electrode 16. Plated layer 3 is prevented from direct contact with ceramic body 10 by glass layer 4.

A drawback to Applicant's previous invention is that the sintered ceramic body is formed by coating both sides of a sheet of ceramic with glass. The glass-coated ceramic is then cut into pieces. This process requires numerous process steps and careful handling, thereby resulting in high manufacturing costs.

When forming a terminal electrode having plating layers on a conductive chip-type ceramic body, another conventional method utilizes ceramic material with a low conductivity. A drawback of this is that a low-conductivity chip requires a larger body due to its low magnetic permeability, which interferes with high density mounting. A substitution of a ferrit based ceramic material with a higher magnetic permeability avoids this inconvenience, but in turn experiences a shift in other characteristics due to plating material adhering to the ceramic body.

To overcome the above drawbacks, Applicant has filed Japanese Laid-Open Patent Publication No. 3-250,601 for a chip-type thermistor. Referring now to FIG. 20, an inner electrode 111 is formed on the end surfaces of ceramic body 10. A copper outer electrode 116 covers inner electrode 111.

A drawback to this approach is that a copper outer electrode 116 imparts significantly less heat resistance than a plated nickel electrode. The need for an outer layer that contacts portions of the surface of the thermistor body to provide good heat resistance, has limited the material for the outer electrode. This in effect complicates the conditions for burning.

OBJECTS AND SUMMARY OF THE INVENTION

Accordingly, it is an object of the invention to provide a ceramic element which overcomes the drawbacks of the prior art.

It is a further object of the invention to provide a ceramic element with increased soldering heat resistance and soldering adhesion.

It is a still further object of the invention to provide a ceramic element having terminal electrodes which minimize the dispersion of the part-to-part resistance values of the ceramic elements.

It is a still further object of the invention to provide a ceramic element with external plated layers on the terminal electrodes which do not directly contact the ceramic body.

Briefly stated, the present invention comprises a ceramic body which is covered by an inorganic insulating layer. The ends of the body are then dipped in a conductive paste and dried. The body is baked, causing the conductive paste to react with the insulating layer which it contacts. The baking occurs at a temperature lower than the melting point of the insulating layer, and thus does not affect the portions of the insulating layer not covered by the conductive paste.

During the baking process, the insulating layer is absorbed by the paste, and together form a baked electrode. This in turn is covered with a plated layer consisting of a first plated layer of nickel and second plated layer of tin.

Since the insulated layer remains intact during the process of forming the baked electrode, the two are integrally formed and completely cover the surface of the ceramic body. This shield prevents the subsequently added plated layers of nickel and tin from contacting the ceramic body. As a result, the element exhibits improved soldering heat resistance and soldering adhesion without an increase in dispersion of resistance values.

In another embodiment of the invention, an inner electrode is formed by screen printing a conductive paste on the ends of the ceramic body prior to being covered with the insulating layer. When the insulating layer later reacts with the paste, the baked electrode electrically communicates with the ceramic body through the inner electrode.

In still another embodiment of the invention, the inner electrode as described in the previous embodiment is applied by dipping the ends of the ceramic body into a conductive paste, thereby wrapping over the edge of the ceramic body onto its sides. The body is baked, and the later added layers of nickel and tin are applied to the baked electrode. Since the inner electrode extends further along the side of the ceramic body, the outer electrodes do not come into direct contact with the insulated sides of the ceramic body.

According to an embodiment of the present invention, there is provided a chip-type ceramic element comprising a conductive ceramic body having opposing end surfaces, terminal electrodes covering the ends, an insulating layer made from an insulating material, the insulating layer covering at least a portion of the ceramic body not covered by the terminal electrodes, the terminal electrodes having at least one layer, and one of the at least one layer being a baked electrode layer.

According to another embodiment of the invention, there is provided a chip-type ceramic element comprising a conductive ceramic body having opposing end surfaces, terminal electrodes covering the ends, an insulating layer made from an insulating material, the insulating layer covering a portion of the ceramic body not covered by both terminal electrodes, both terminal electrodes including a baked electrode layer, the baked electrode layer being a baked combination of the insulating material and a conductive paste, and the conductive paste being a combination of a metal powder and an inorganic binding material.

According to a further embodiment of the invention, there is provided a chip-type ceramic element comprising a conductive ceramic body having opposing end surfaces, a terminal electrodes covering the ends, an insulating layer made from an insulating material, the insulating layer covering a portion of the ceramic body not covered by the terminal electrodes, both electrodes including a first inner electrode layer, both terminal electrodes including a second baked electrode layer, the baked electrode layer being a baked combination of the insulating material and a conductive paste, and the conductive paste being a combination of a metal powder and an inorganic binding material.

According to a still further embodiment of the invention, there is provided a method for producing a chip-type element comprising burning a chip to produce a ceramic body, covering the ceramic body with an insulating material, applying a conductive paste to the insulating material at a either end of the ceramic body, and reacting the conductive paste with the insulating layer to form an electrode.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1 is a perspective view of the first embodiment of the present invention with a portion cut-away.

FIG. 2 is a cross section of the first embodiment taken along line 2—2 in FIG. 1.

FIG. 8 is a perspective view of a second embodiment of the present invention with a portion cut-away.

FIG. 9 is a cross section of the second embodiment taken along line 9—9 in FIG. 8.

FIGS. 10(*a*)–10(*g*) illustrate the process steps for manufacturing the second embodiment.

FIG. 12 illustrates an expanded cross section of the second embodiment taken along line 12—12 in FIG. 10(*e*).

FIG. 13 illustrates an expanded cross section of the second embodiment taken along line 13—13 in FIG. 10(*f*).

FIG. 14 is a perspective view of a third embodiment of the present invention with a portion cut-away.

FIG. 15 is a cross section of the third embodiment taken along line 14—14 in FIG. 14.

FIGS. 16(*a*)–16(*g*) illustrate the process steps for manufacturing the third embodiment.

FIG. 17 illustrates an expanded cross section of the third embodiment taken along line 17—17 in FIG. 16(*e*).

FIG. 18 illustrates an expanded cross section of the third embodiment taken along line 18—18 in FIG. 16(*f*).

DETAILED DESCRIPTION OF THE PREFERRED EMBODIMENT

Figure 3A:
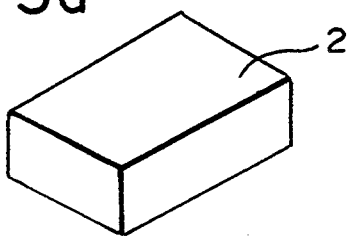
FIGS. 3(*a*)–3(*g*) illustrate the process steps for manufacturing the embodiment of FIGS. 1 and 2.
Figure 3B:
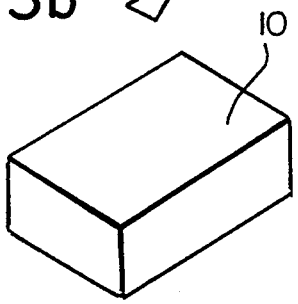
Figure 3C:
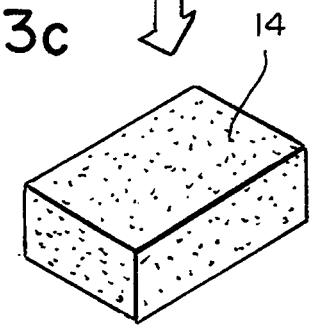
Figure 3D:
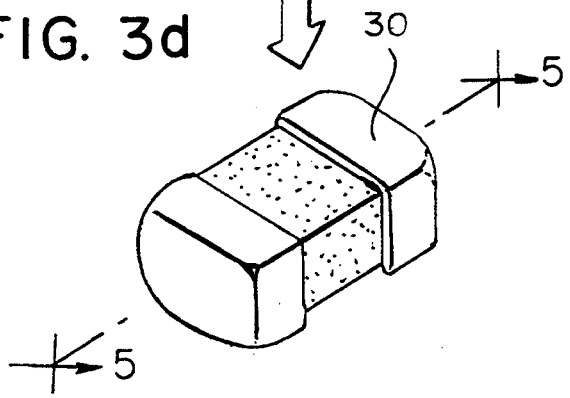
Figure 3E:
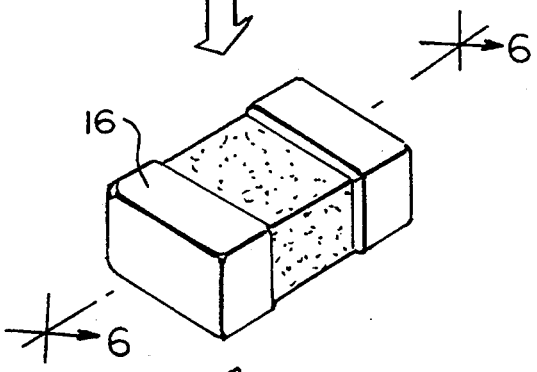
Figure 3F:
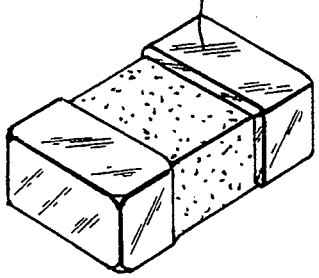
Figure 3G:
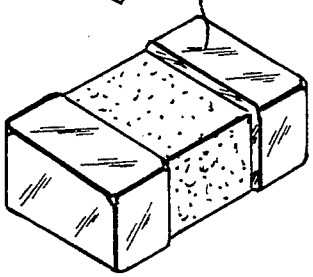

Referring to FIGS. 1 and 2, there is shown a chip-type conductive ceramic element in accordance with the invention. A ceramic body 10 is enclosed at opposite ends by a pair of terminal electrodes 12. Each terminal electrode 12 consists of a baked electrode 16, a Ni plating layer 18, and a Sn plating layer 19. The surface of ceramic body 10 between terminal electrodes 12 is encased in an inorganic insulating layer 14.

Referring to FIG. 3(*a*), the above embodiment is manufactured as follows. A combination of metal oxide powders form ceramic body 10 based on its intended function. For example, a thermistor is made from any appropriate combination of Mn, Fe, Co, Ni, Cu and Al. For a varistor, any of Ti, Ce, Ca, Sb and N is used. An inductor requires any of Fe, Co, Ni, Zn and Mn.

The desired oxides are mixed according to prescribed atomic ratios and the resulting mixture is calcined to dry and solidify the mixture. The solidified mixture is ground to a powder. An organic binding material and a solvent are added to the powder, and kneaded to form a slurry. This slurry is in turn shaped into a film by, for example, a doctor blade. The sheet is dried, and a green body 2 is punched therefrom.

Referring now to FIG. 3(*b*), green body 2 is burned to sinter it into ceramic body 10. After sintering, it is preferable to take off the sharp corners of ceramic body 10 by, for example, tumbling in a barrel.

Referring now to FIG. 3(*c*), the entire surface of ceramic body 10 is covered with an inorganic insulating layer 14 having a thickness of 0.1 to 6 μm. If the thickness exceeds 6 μm, then insulating layer 14 will not be completely absorbed during the formation of baked electrode 16. An unabsorbed portion would solidify between baked electrode 16 and ceramic body 10, thereby preventing electrical conduction between terminal electrode 12 and ceramic body 10. On the other hand, if the thickness of inorganic insulating layer 14 is less than 0.1 μm, ceramic body 10 receives insufficient protection following a later described plating process.

Insulating layer 14 may be composed of a thin film of $SiO_2$, or at least 50% $SiO_2$ by weight, with the balance being one or more oxides selected from the group consisting of $Al_2O_3$, MgO, $ZrO_2$ and $TiO_2$. In the alternative, a thin film of glass can be used containing one or more oxides selected from the group consisting of $SiO_2$, $B_2O_3$, $Na_2O$, PbO, ZnO and BaO.

The only limitations on the above combinations of materials selected to form insulating layer 14 are (1) the combination is plating-resistant, and (2) the insulating layer 14 will melt and react with the inorganic binding material contained in a later added conductive paste layer to form baked electrode 16. Although the combination may be non-crystallized, a crystallized glass composition is preferred for increased bending strength.

The selected materials which form insulating layer 14 may be coated on ceramic body 10 by any standard techniques, e.g. physical or chemical vapor deposition, e.g. vacuum deposition, sputtering, or ion plating. Sputtering is preferred due to its suitability for mass production.

Figure 4:
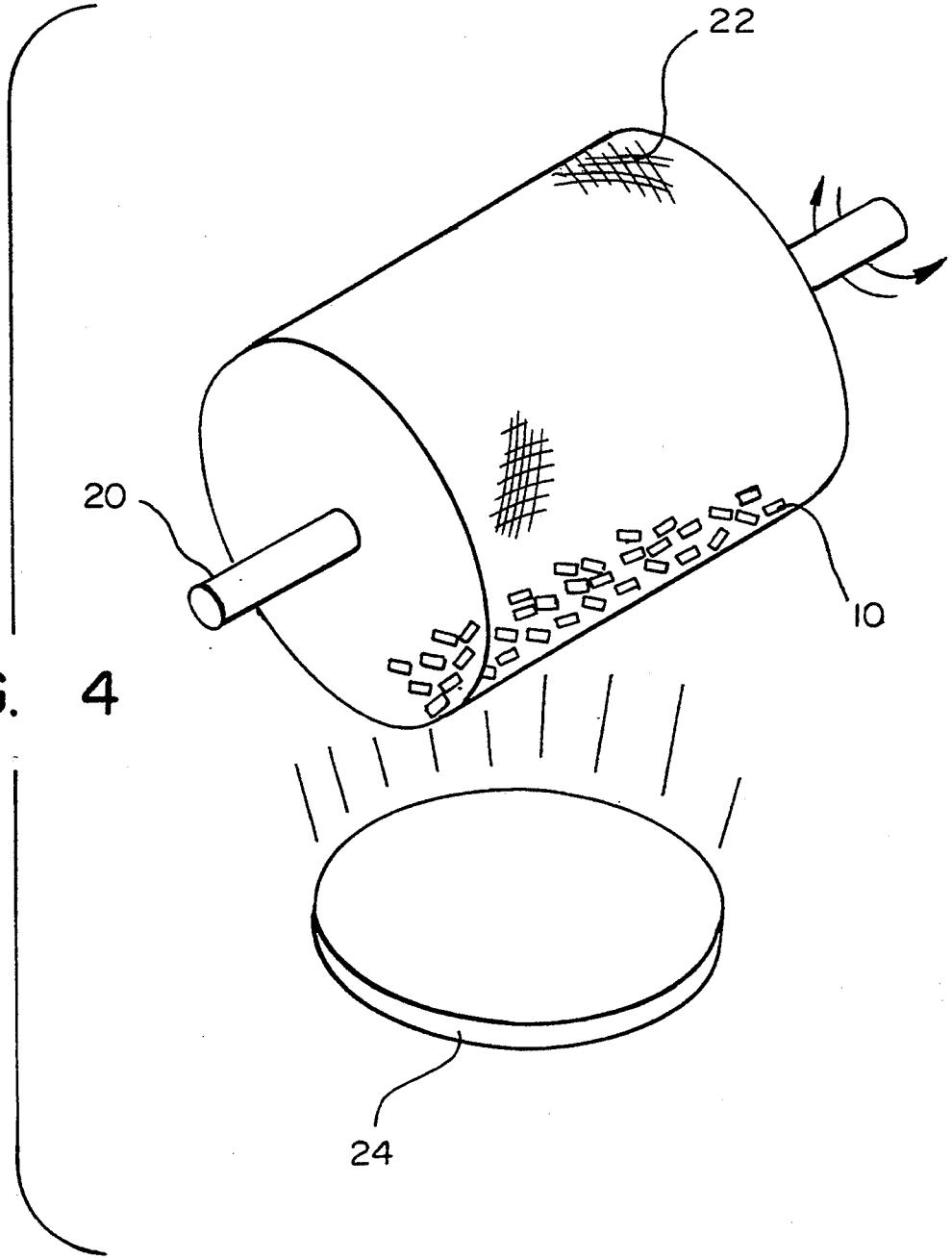
FIG. 4 is a perspective view of an apparatus for sputtering ceramic bodies with an insulating inorganic layer.

Referring now to FIG. 4, the process of coating ceramic body 10 with insulating layer 14 is shown. Several ceramic bodies 10 are placed inside a basket 22 which rotates about a horizontal axis 20. A target 24 supplies inorganic material for sputtering over the surface of ceramic body 10, thereby forming insulating layer 14.

Referring now to FIG. 3(*d*), a conductive paste 30, composed of a metal powder and an inorganic binding material, is uniformly applied over insulating layer 14 at opposite ends of ceramic body 10 via dipping. Examples of the metal powder may be any noble metal such as Ag, Au, Pd and Pt. The inorganic binding material is preferably composed of borosilicate glass, zinc borate glass, cadmium borate glass, lead-silicate glass, and other glass particles. These other glass particles are preferably comprised of one or more oxides from the group consisting of $SiO_2$, $B_2O_3$, $Na_2O$, PbO, ZnO, $TiO_2$, $K_2O$ and BaO.

Figure 5:
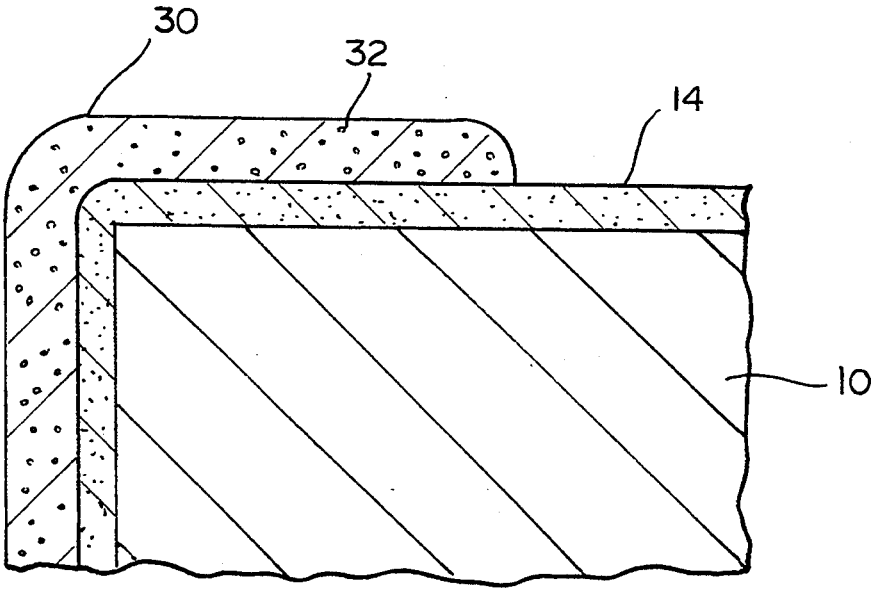
FIG. 5 illustrates an expanded cross section of the first embodiment taken along line 5—5 in FIG. 3(*d*).

Referring now to FIG. 3(*d*) and FIG. 5, conductive paste 30 is burned to form a baked electrode 16. Burning is conducted at a temperature which is lower than the melting point or softening point of insulating layer 14. This temperature does not affect the exposed portion of insulating layer 14, but does cause inorganic binding material 32 of paste 30 to react with a primer portion of insulating layer 14. The inorganic portion of a now fluidized insulating layer 14 penetrates into fine holes created in paste 30 caused by the sintering of the metal.

Figure 6:
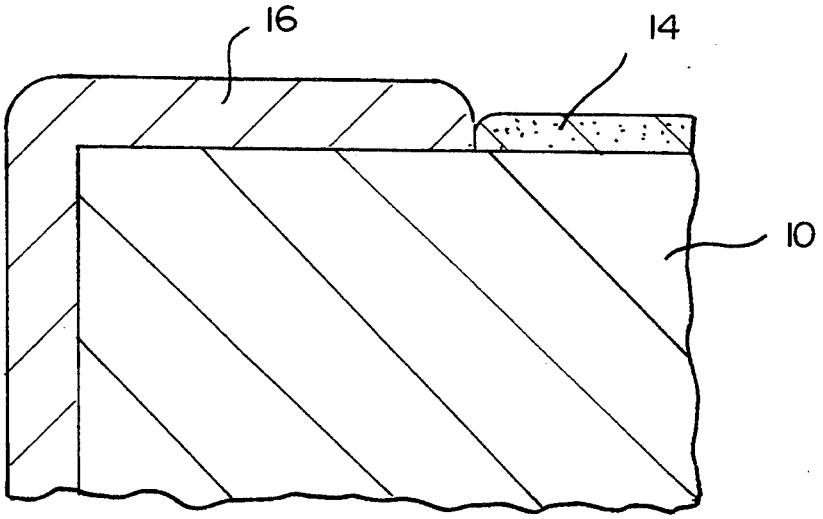
FIG. 6 illustrates an expanded cross section of the first embodiment taken along line 6—6 in FIG. 3(*e*).
Figure 7A:
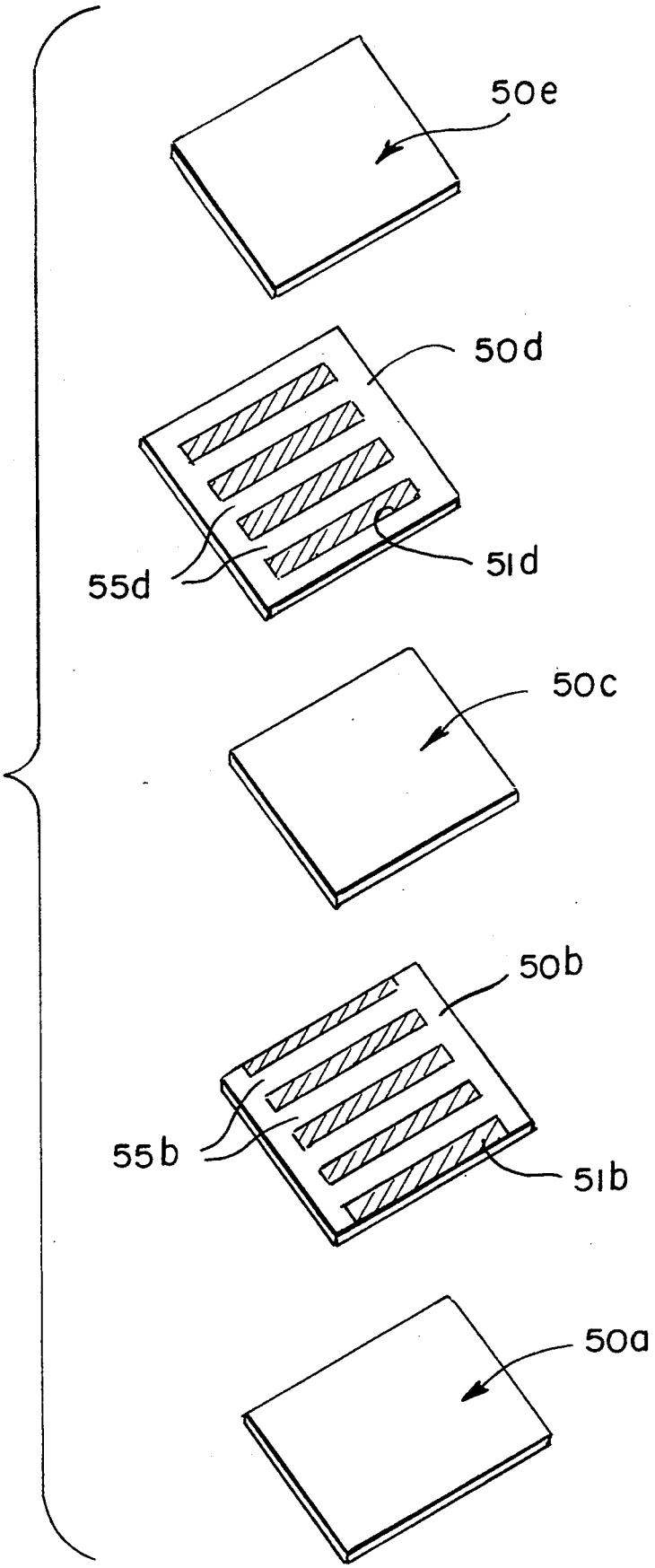
FIGS. 7(*a*)–7(*e*) illustrate the process steps for manufacturing a chip-type layer varistor according to the first embodiment.
Figure 7B:
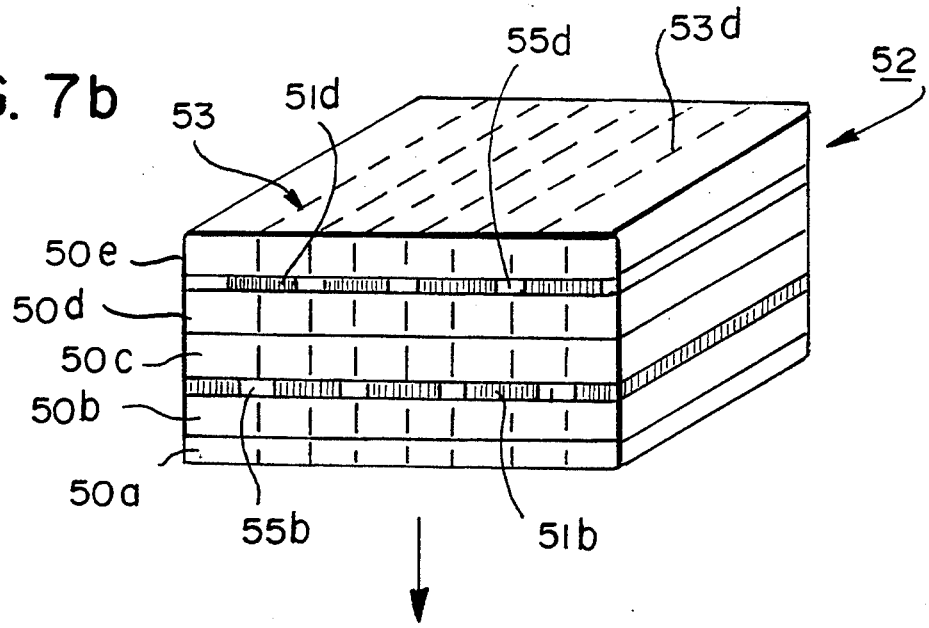
Figure 7C:
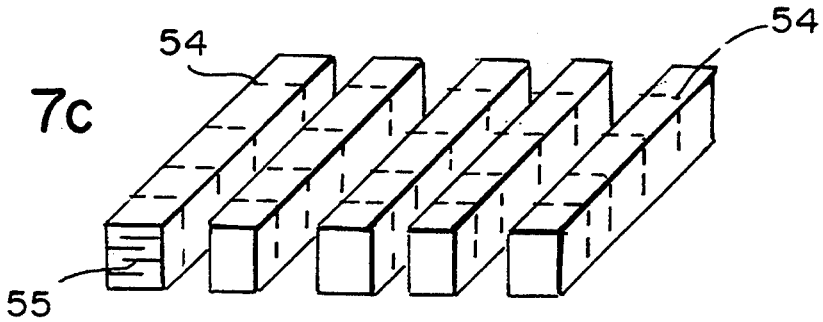
Figure 7D:
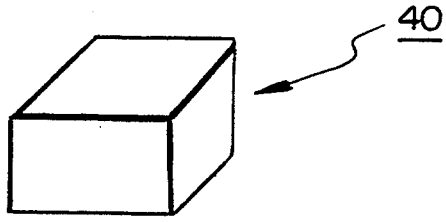
Figure 7E:
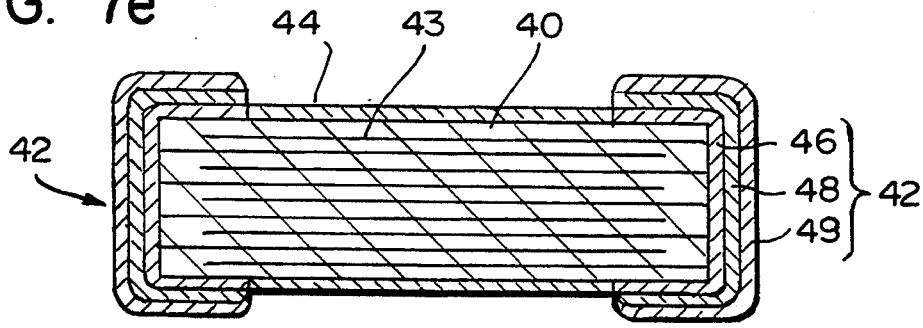

Referring now to FIG. 6, those portions of insulating layer 14 which were covered by paste 30 are completely absorbed into paste 30, and together form baked electrode 16. As a result, baked electrode 16 and ceramic body 10 adhere to each other and communicate electrically. Since the portion of insulating layer 14 not covered with paste 30 is unaffected by the burning, it remains in contact with ceramic body 10 and maintains its insulating properties.

Referring now to FIG. 3(*f*), Ni plating layer 18 is formed on baked electrode 16. This layer has the function of improving the soldering heat resistance of baked electrode 16, thereby preventing erosion caused by soldering.

Referring now to FIG. 3(*g*), Sn plating layer 19 is formed on Ni plating layer 18. This layer has the function of improving soldering adhesion. Together, baked electrode 16, Ni plating layer 18 and Sn plating layer 19 form terminal electrode 12.

A chip-type varistor which incorporates this embodiment is shown in FIGS. 7(*a*)–7(*e*). Referring to FIG. 7(*a*), the layers of the varistor include ceramic sheets 50*a*, 50*b*, 50*c*, 50*d* and 50*e*. Ceramic sheets 50*b* and 50*d* have Pt paste strips 51*b* and 51*d* applied thereto, respectively. Each of Pt paste strips 51*b* and 51*d* are separated by gaps 55*b* and 55*d*, respectively, and are disposed so that each Pt paste strip 51*b* and 51*d* overlaps a gap 55*d* and 55*b*, respectively.

Ceramic sheet 50*a* serves as the first layer of the varistor. Ceramic sheets 50*b* is on ceramic sheet 50*a*. Ceramic sheet 50*c* is placed on ceramic sheet 50*b*, thereby covering Pt paste 51*b*. Ceramic sheet 50*d* is placed on ceramic sheet 50*c*. Ceramic sheet 50*e* is placed on ceramic sheet 50*d*, thereby covering Pt paste 51*d*.

Referring now to FIG. 7(*b*), ceramic sheets 50*a–e* are pressure connected and heated. The sheets fuse together and form a ceramic block 52.

Dotted lines 53 illustrates were ceramic block 52 will be cut into smaller units. Each dotted line 53 is positioned to cut through one of the Pt paste strips 51*b* and 51*d*, and a corresponding one of gaps 55*d* and 55*b*.

Ceramic block 52 is not limited in the number of ceramic sheets which may be used. Any amount may be employed based on the desired parameters of the varistor.

Referring now to FIG. 7(*c*), ceramic block 52 is cut to form ceramic strips 54. The location of dotted lines 53 ensures that Pt paste strips 55 alternately contact one of the two ends of ceramic strip 54.

Ceramic strips 54 are then heated at 1300° under atmospheric pressure and barrel ground to form ceramic bodies 40 shown in FIG. 7(*d*).

Referring now to FIG. 7(*e*), ceramic body 40 consists of multiple ceramic sheets 50 prepared according to the above steps. Insulating layer 44 and terminal electrodes 42, which include baked electrode 46, plated Ni 48 and plated Sn 49, are applied to ceramic body 40 according to the manner of the first embodiment.

A second embodiment of the invention is shown in FIGS. 8 and 9. A pair of inner electrodes 111 cover the ends of ceramic body 10. Insulating layer 14 covers inner electrodes 111 and the exposed portion of ceramic body 10. Insulating layer 14 is in turn covered at the ends of ceramic body 10 by outer electrode 116, Ni plating layer 18, and Sn plating layer 19. Electrical continuity between inner electrodes 111 and outer electrodes 116 takes place during the foregoing processes.

A ceramic element according to the second embodiment is manufactured as follows. Referring now to FIGS. 10(*a*) and 10(*b*), chip-type ceramic body 10 is manufactured in the same manner as the preferred embodiment.

Referring now to FIG. 10(*c*), a conductive compound is applied by screen printing to the ends of ceramic body 10. This process is illustrated in FIGS. 11(*a*)–11(*c*).

Figure 11A:
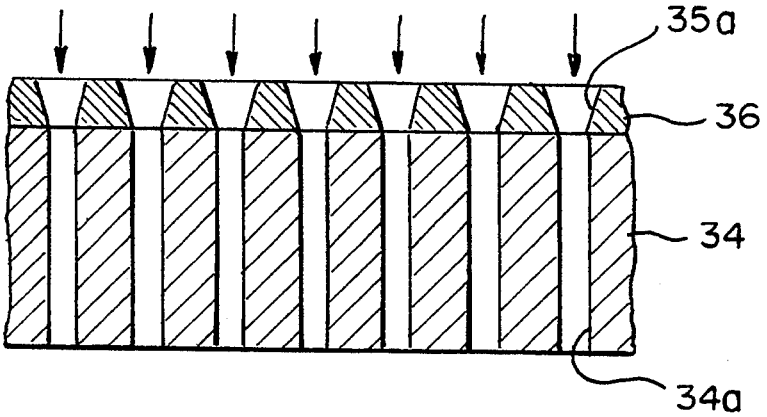
FIGS. 11(*a*)–11(*c*) illustrate the apparatus for screen printing the ends of the ceramic bodies with a conductive metal.
Figure 11B:
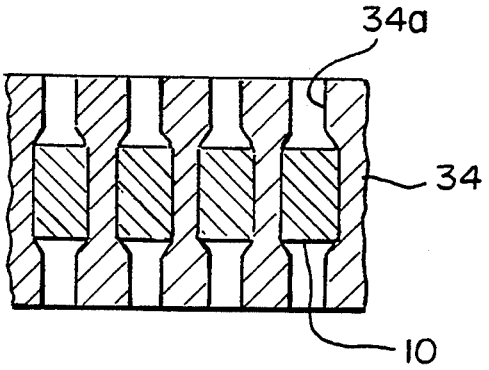
Figure 11C:
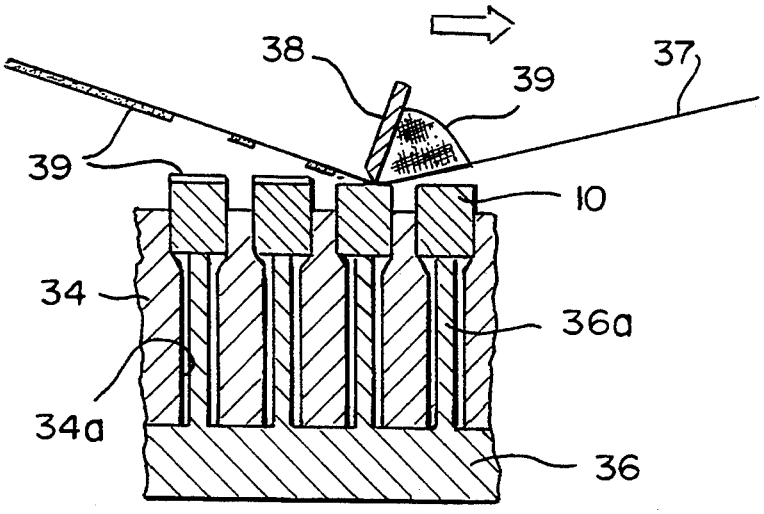
Figure 19:
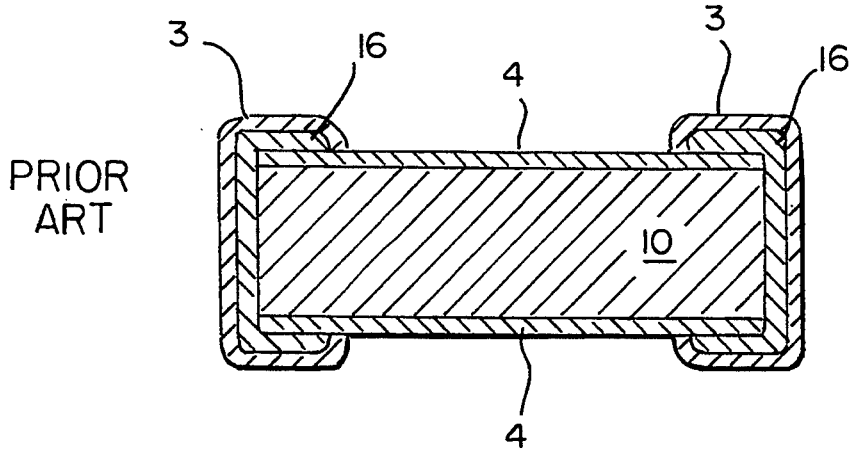
FIG. 19 illustrates a cross section of a ceramic element according to the prior art.
Figure 20:
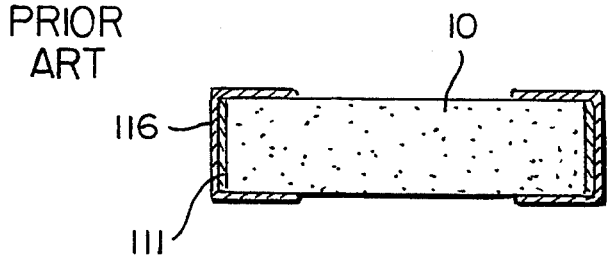
FIG. 20 illustrates a cross section of a ceramic element according to the prior art.

Referring now to FIG. 11(*a*), an elastic holding plate 34 has a plurality of holding chambers 34*a*. A loading plate 35 has a plurality of loading holes 35*a* for allowing insertion of ceramic body 10 into holding chamber 34*a*.

Referring now to FIG. 11(*b*), ceramic bodies 10 are placed in loading holes 35*a*. A negative pressure is applied to the base of each loading chamber 34*a*, pulling the ceramic bodies inside.

Referring now to FIG. 11(*c*), an extruder 36 with pins 36*a* force the top end of ceramic bodies 10 to emerge to a uniform height above the top of chamber 34*a*. A conductive paste 39 is forced through a screen 37 by a squeegee 38 to cover the end of ceramic bodies 10. Once dry, the process is repeated to cover the other end of ceramic bodies 10.

Ceramic body 10 is then dried and baked, converting the conductive compound into inner electrodes 111. This conductive compound may be any alloy of silver, silver-palladium, gold, or platinum.

Referring now to FIG. 10(*d*), ceramic body 10 and inner electrodes 111 are covered by insulating layer 14. The layer is applied by the same techniques as described in reference in the first embodiment, but the thickness ranges from 0.1 to 10 μm. As in the first embodiment, the insulating properties of insulating layer 14 are reduced when the layer is less than 0.1 μm thick. On the other hand, if the layer is thicker than 10 μm, the layer remains on the interface between inner electrode 111 and later formed outer electrode 116, and prevents electrical contact therebetween.

Referring now to FIG. 10(*e*) and 12, the ends of ceramic body 10 are dipped in conductive paste 30.

Referring now to FIG. 10(*f*) and 13, the element is burned at a temperature lower than the melting point of insulating layer 14. Inorganic binding material 32, which is uniformly dispersed in paste 30, reacts with insulating layer 14. Inorganic portion of insulating layer 14 begins to melt, and penetrates into holes naturally produced in paste 30 during sintering of the metal.

A portion of insulating layer 14 is absorbed into paste 30, forming outer electrode 116. Outer electrode 116 establishes electrical communication with inner electrode 111. Inner electrode 111 acts as a bridge between ceramic body 10 and outer electrode 116.

Referring now to FIGS. 10(*g*) and 10(*h*), Ni plating layer 18 and Sn plating layer 19 are formed on outer electrode 116. These layers have the same functions as in the previous embodiment. Together, inner electrode 111, outer electrode 116, Ni plating layer 18 and Sn plating layer 19 form terminal electrode 12.

The above described second embodiment is preferred when (1) insulating layer 14 is composed of at least 50% by weight $SiO_2$ and one or more oxides selected from the group consisting of $Al_2O_3$, MgO, $ZrO_2$ and $TiO_2$, and (2) inorganic binding material 32 is composed mainly of one or oxides selected from the group consisting of $SiO_2$, $B_2O_3$, $Na_2O$, PbO, $TiO_2$, ZnO, $K_2O$ and BaO.

In this embodiment, inner electrode 111 has a wrapping area which is limited to the end of ceramic body 10. In contrast, paste 30 has a wrapping area which extends on to the sides of ceramic body 10 after baking. A section of insulating layer 14 is thus in contact with paste 30, but not with inner electrode 111.

When this section of insulating layer 14 is baked, a portion of outer electrode 116 can directly contact ceramic body 10 if insulating layer 14 is less than 2 μm. Because the connection between outer electrode 116 and ceramic body 10 is only partial, however, the conductivity between the two is negligible when compared to the conductivity of the interface at inner electrode 111. As a result, substantially all electric current flows from outer electrode 116 to ceramic body 10 through inner electrode 111.

A third embodiment of the present invention is shown in FIGS. 14 and 15. This embodiment is preferred when (1) insulating layer 14 is composed of one or more oxides selected from the group consisting $SiO_2$, $B_2O_3$, $Na_2O$, PbO, ZnO and BaO, and (2) inorganic binding material 32 is composed of one or more oxides selected from the group consisting $SiO_2$, $B_2O_3$, $Na_2O$, PbO, ZnO, BaO, $TiO_2$ and $K_2O$. In this embodiment, the wrapping area (the length along the peripheral surfaces) of outer electrode 116 is smaller than the wrapping area of inner electrode 111.

Referring now to FIG. 16(*a*)–16(*h*), the processing steps are identical to the second embodiment, except that, as seen in FIG. 16(*c*), conductive paste 30 is applied via dipping instead of screen printing. Enough paste 30 is applied such that a section extends beyond the subsequently plating layers of nickel and tin.

Referring now to FIG. 17 and 18, when outer electrode 116 is formed via burning, the overlap of inner electrode 111 ensures that any holes 112 through insulating layer 14 contact only inner electrode 111, and prevents electrical contact between outer electrode 116 and ceramic body 10.

The conductive chip-type ceramic element of the present invention is completely covered with an inorganic insulating layer except in those areas covered by the terminal electrodes, thereby protecting the ceramic body. In combination with the Ni and Sn plating layers, the element has improved soldering heat resistance and soldering adhesion properties.

In addition, the inner electrode of the second and third embodiments provides a smaller part-to-part resistance dispersion and allows for a wider selection of materials for the outer electrode layer. In the case of the third embodiment, the isolation of the outer electrode from the ceramic body allows for insulating layer 14 of the minimum 0.1 μm, which reduces production time and cost.

EXAMPLES

Having described preferred embodiments of the invention with reference to the accompanying drawings, the following examples are provided to illustrate the differing embodiments of present invention. It is to be understood that the following examples are not intended to limit the scope or application of the present invention.

Example 1

A chip-type ceramic thermistor according to the first embodiment of the invention was manufactured as follows. Commercially available $MnO_2$, NiO and CoO were mixed in a weight ratio of 3:1:2. The mixture was mixed together for 16 hours in a ball mill, then dehydrated and dried. The mixture was then calcined for two hours at 900° C. The calcined product was again ground in the ball mill, dehydrated and dried. Relative to 100% of the final mixture, a combination of binding materials including 6% polyvinyl butylar, 30% ethanol and 30% butanol were added to the ground calcined product and mixed to form a slurry.

The slurry was formed into a film by a doctor blade and dried to form a green sheet 0.80 mm thick. A 2.34 mm×1.48 mm chip was punched from this sheet and burnt at 1,200° C. and atmospheric pressure for four hours. The chip was then subject to barrel grinding to knock off sharp corners and to produce a sintered body having a length of 1.9 mm, a width of 1.2 mm and a thickness of 0.5 mm.

A 2 μm inorganic insulating layer of $SiO_2$ film was formed over the entire surface of the sintered body by sputtering. A conductive paste was applied by dipping both end portions of the ceramic body having the inorganic layer thereon. This conductive paste was commercially available silver paste (manufactured by Dupont: JPN-1176J) comprised of Ag powder, fine glass particles of $SiO_2$, $TiO_2$, $B_2O_3$, $Na_2O$ and $K_2O$, and an organic vehicle.

After drying the paste at atmospheric pressure, the ceramic body was heated from room temperature to 820° C. at a rate of 30° C./minute. This temperature was maintained for ten minutes, then cooled to room temperature at the same rate. during this period, the inorganic layer and paste combined to form a baked electrode layer.

The baked electrode layer was subsequently covered with a plated layer of Ni 2 to 3 μm thick. This layer of nickel was then covered with a Sn plated layer 1 to 2 μm thick.

COMPARATIVE EXAMPLE 1

A plated chip-type thermistor was prepared in the same manner as in Example 1 described above, except that no inorganic insulating layer was formed.

COMPARATIVE EXAMPLE 2

A terminal electrode was formed only with a baked electrode layer of silver-palladium alloy paste (80% Ag: 20% Pd) at 850° C. No subsequent plated layers were applied.

COMPARATIVE TEST AND RESULTS

Plating adhesion to ceramic body

The ceramic body surfaces of the chip-type of Example 1 and the chip of Comparative Example 1 were analyzed under an optical microscope. In Example 1 samples, the plated layers were limited to the terminal electrode. In Comparative Example 1, the plating material overlapped the terminal electrode and came into direct contact with the ceramic body.

Soldering Adhesion

Three hundred samples were prepared according to the method of Example 1 and Comparative Example 2. Each sample was immersed into an eutectic soldering (H60-A) bath, containing silver melted at a temperature of 230° C., for a period of four seconds. Of the 300 Example 1 Samples, 100% maintained soldering adhesion over at least 95% of the surface area. Of the 300 Comparative Example 2 samples, only 72% maintained adhesion of at least 95% of the surface area. These results are summarized in Table 1.

Soldering Heat Resistance

Three hundred samples were prepared according to the method of Example 1 and Comparative Example 2. Each sample was immersed into an eutectic soldering (H60-A) bath, containing silver melted at a temperature of 350° C., for a period of thirty seconds. Upon removal, the samples were analyzed for the percentage loss of the terminal electrode. Of the Comparative Example 2 group, the average loss was 17%. The Example 1 group experienced no loss (0%). These results are also summarized in Table 1.

TABLE 1

| | Samples | Soldering adhesion Ratio of soldering adhering area ≧ 95% | Soldering heat resistance Ratio of lost portion of electrode |
|---|---|---|---|
| Example 1 | 300 | 100% | 0% |
| Comparative Example 2 | 300 | 72% | 17% |

Example 2

A layer built chip-type varistor comprising $TiO_2$ chip-type ceramic varistor as shown in FIG. 7 was manufactured as follows. Fine particles of borosilicate glass and metal oxides of Ce, Ca, Nb, and Sb were mixed in slight amounts to commercially available titanium oxide. These compounds were uniformly mixed together for 16 hours in a ball mill, then dehydrated and dried. The mixture was then calcined and ground as in Example 1. An organic binding material was added to the ground mixture and uniformly mixed to prepare a slurry.

The slurry was formed into a film by a doctor blade and dried to form a green sheet 30 μm thick. A 120 mm×120 mm chip was punched from this sheet and inspected for thickness. Pt paste was screen-printed on one surface of the sheet, which was dried to form an internal electrode.

The green sheet with the inner electrode was subsequently laminated on both sides with other green sheets, which act as a protective film. These sheets were cut into chips and heated at 1300° C. under atmospheric pressure to form a pressure connection. The layered chips were then barrel-ground into sintered bodies of length 2.1 mm, width 1.3 mm, and a thickness of 0.7 mm.

An inorganic insulating layer of a $SiO_2$ film was formed on the entire surface of the sintered body to a thickness of 2 μm in the same manner as in Example 1. A conductive paste was applied to both ends of the sintered body and baked to form a baked electrode layer. This baked electrode layer was subsequently covered with 2 to 3 μm of Ni and 1 to 2 μm of Sn.

Comparative Example 3

A plated chip-type varistor was prepared in the same manner as in Example 2 described above, except that no inorganic insulating layer was formed.

Comparative tests and results

Plating adhesion to ceramic body

The ceramic body surfaces of the thermistor of Example 2 and the thermistor of Comparative Example 3 were analyzed under an optical microscope. In Example 2, the plated layers were limited to the terminal electrode. In Comparative Example 3, the plating material overlapped the terminal electrode and came into direct contact with the ceramic body.

Example 3

A chip-type ceramic varistor according to the second embodiment of the invention was manufactured as follows. A sintered body having a length of 1.9 mm, a width of 1.2 mm and a thickness of 0.65 mm was prepared in the same manner as in Example 1. A conductive metal was then screen printed onto the ends of the body and baked at 800° C. at atmospheric pressure to form an inner electrode.

After cooling, the entire element was coated with an inorganic insulating layer of $SiO_2$ by sputtering, and an outer electrode was formed over the ends of the inner electrode and the peripheral sides of the body. The ceramic body was then heated in the same manner as Example 1. During this period, the inorganic layer and paste combined to form a baked electrode layer.

The baked electrode layer was then plated at the ends with a layer of nickel and tin in the same manner as Example 1.

Comparative Example 4

A plated chip-type varistor was prepared in the same manner as in Example 3 described above, except that no inner electorde or inorganic insulating layer were formed.

Comparative Example 5

A plated chip-type varistor was prepared in the same manner as in Example 3 described above, except that the inorganic insulating layer, inner electrode layer, Ni and Sn plating layers were not formed.

Comparative Tests and Results

Plating adhesion

The ceramic body surfaces of the thermistor of Example 3 and the thermistor of Comparative Example 4 were analyzed under an optical microscope. The plated layers of the Example 3 samples were limited to the surface of the terminal electrode. In Comparative Example 4, the plating material overlapped the terminal electrode and came into direct contact with the ceramic body.

Dispersion of Resistance Value

One hundred samples of the thermistor of Example 3 and Comparative Example 5 were prepared. The resistance value of each sample was measured to calculate the dispersion as the ratio of the standard deviation over the average measured resistance value. The Example 3 thermistors showed a dispersion of 1.04%, whereas the Comparative Example 5 samples showed a dispersion of 3.27%.

Example 4

A chip-type ceramic thermistor according to the third embodiment of the invention was manufactured as follows. A number of sintered bodies having a length of 1.9 mm, a width 1.2 mm and a thickness of 0.65 mm were prepared according to the method of Example 1. Silver paste was applied to ends of the bodies via dipping. After drying the paste, the ceramic bodies were baked at 800° C. at atmospheric pressure to form the inner electrode. The entire surface of each chip was then sputtered with a composite oxide film to form an insulating layer 2 μm thick.

A conductive paste was applied to the insulating layer at the ends of the ceramic body via dipping. The paste was applied with a smaller wrapping area than that of the inner electrode. The conductive paste was a commercially available silver paste (manufactured by Dupont: JPN-1176J) comprised of Ag powder, fine glass particles of $SiO_2$, $TiO_2$, $B_2O_3$, $Na_2O$ and $K_2O$, and an organic vehicle.

After drying the paste at atmospheric pressure, the ceramic body was heated to 820° C. at a rate of 30° C./minute. This temperature was maintained for ten minutes, then cooled to room temperature at the same rate. During this period, the inorganic layer combined with the paste to form the baked electrode layer.

The baked electrode was subsequently covered with a plated layer of Ni 2 to 3 μm thick. This layer of nickel was then covered with a Sn plated layer 1 to 2 μm thick.

Comparative Example 6

A sintered body was prepared according to the method of Example 1. This sintered body was then formed into a thermistor according to the method of Example 3, in which the inner electrode does not wrap onto the sides of the ceramic body.

Comparative Tests and Results

Dispersion of Resistance Value

One hundred samples of the thermistors of Example 4 and Comparative Example 6 were prepared. The resistance value of the individual sample thermistors were measured to calculate the shift of the average resistance value from the standard resistance value, and the dispersion of resistance values. As seen in Table 2, the shift for the average resistance value and the dispersion value were much lower for the Example 4 samples than for the Comparative Example 6 samples.

TABLE 2

| | Number of chips with outer electrode connected to thermistor body | Shift of average resistance value from standard resistance value | Dispersion of resistance value (stndard deviation/average resistance value |
|---|---|---|---|
| Example 4 | 0 | 0.13% | 1.23% |
| Comparative Example 6 | 10 | 1,34% | 5.19% |

Analysis of Ground Faces.

The above thermistor samples were ground to expose the cross section as shown in FIG. 15, and the number of chips in which the outer electrode came into contact with the ceramic body were counted. None of the Example 4 chips experienced an outer electrode - ceramic body contact. Ten of the 100 Comparative Example 6 chips did show contact.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A chip-type ceramic element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first layer contacting said ceramic body; and said first layer being a baked electrode layer, wherein said baked electrode layer is a burned combination of said insulating material and a conductive paste.

2. A chip-type element according to claim 1, said insulating layer includes:

at least 50% by weight $SiO_2$; and a remainder being at least one oxide selected from the group consisting of $Al_2O_3$, MgO, $ZrO_2$, and $TiO_2$.

3. A chip-type element according to claim 1, wherein said insulating layer includes at least one oxide selected from the group consisting of $SiO_2$, $B_2O_3$, $Na_2O$ PbO, ZnO and BaO;

said chip-type element further comprising:

said conductive paste including a binding material; and said conductive paste including at least one oxide selected form the group consisting of $SiO_2$, $B_2O_3$, $Na_2O$, PbO, ZnO, $TiO_2$, $K_2O$ and BaO; said conductive paste having been heated to a temperature to react with said insulating layer.

4. A chip-type element according to claim 2, wherein said insulating layer is a crystallized glass.

5. A chip-type element according to claim 3, wherein said insulating layer is a crystallized glass.

6. A chip-type ceramic element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first layer contacting said ceramic body;

said first layer being a baked electrode layer, wherein said baked electrode layer is a burned combination of said insulating material and a conductive paste; and each said terminal electrode includes a second layer of nickel on said baked electrode layer; and each said terminal further includes a third layer of tin on said second layer.

7. A chip-type ceramic element comprising:

a conductive ceramic body having opposing end surfaces;

a terminal electrode covering each of said opposing end surfaces;

an insulating layer made from an inorganic insulating material;

wherein said insulating layer covers an entire surface of said ceramic body except for portions of said ceramic body covered by each of said terminal electrodes; each said terminal electrode including a first layer contacting said ceramic body; and said first layer being a baked electrode layer, wherein said baked electrode layer is a burned combination of said insulating material and a conductive paste.

8. A chip-type element according to claim 5, wherein said insulating layer is 0.1 to 6 μm thick, thin enough to permit substantial absorption during formation of said baked electrode layer.

9. A chip-type element according to claim 5, wherein said insulating layer is a crystallized glass.

10. A chip-type element according to claim 5, further comprising:

a conductive inner electrode in electrical contact with each of said opposing end surfaces;

said insulating layer covering said conductive inner electrode;

said baked electrode layer covering said conductive inner electrode and at least a portion a portion of said insulating layer on sides of said conductive ceramic body;

means for electrically connecting said conductive inner electrode to said baked electrode layer through said insulating layer; and said means for electrically connecting including openings in said insulating layer produced by reaction of said insulating layer with said baked electrode layer.

11. A chip-type element according to claim 10, wherein said baked electrode layer is a burned combination of said insulating material and a conductive paste.

12. A chip-type element according to claim 10, wherein said terminal electrode includes:

a layer of nickel on said baked electrode layer; and a layer of tin on said layer of nickel.

13. A chip-type element according to claim 12, wherein said insulating layer is 0.1 to 10 μm thick.

14. A chip-type element according to claim 12, said insulating layer includes:

at least 50% by weight $SiO_2$; and a remainder being at least one oxide selected from the group consisting of $Al_2O_3$, MgO, $ZrO_2$, and $TiO_2$.

15. A chip-type element according to claim 12, wherein said insulating layer comprises at least one oxide selected from the group consisting of $SiO_2$, $B_2O_3$, $Na_2O$ PbO, ZnO and BaO.

16. A chip-type element according to claim 12, further comprising:

said conductive paste including a binding material; and said binding material including at least one oxide selected from the group consisting of $SiO_2$, $B_2O_3$, $Na_2O$, PbO, ZnO, $TiO_2$, $K_2O$ and BaO.

17. A chip-type element according to claim 12, wherein said conductive inner electrode includes substantially no wrapping area about peripheral surfaces of said ceramic body.

18. A chip-type element according to claim 17, wherein said insulating layer is 6 to 10 μm thick.

19. A chip-type element according to claim 12, wherein said conductive inner electrode includes a substantial wrapping area over peripheral surfaces of said ceramic body.

20. A chip-type element according to claim 19, further comprising:

said terminal electrode including an outer electrode over said at least one layer;

said conductive inner electrode having a first wrapping area;

said outer electrode having a second wrapping area; and said first wrapping area being larger than said second wrapping area.

21. A chip-type element according to claim 12, further comprising:

said insulating layer including at least 50% by weight $SiO_2$;

a remainder of said insulating layer being at least one oxide selected from the group consisting of $Al_2O_3$, MgO, $ZrO_2$, and $TiO_2$;

said conductive paste including a binding material; and said binding material including at least one oxide selected from the group consisting of $SiO_2$, $B_2O_3$, $Na_2O$, PbO, ZnO, $TiO_2$, $K_2O$ and BaO.

22. A chip-type element according to claim 12, further comprising:

said insulating layer including at least one oxide selected from the group consisting of $SiO_2$, $B_2O_3$, $Na_2O$ PbO, ZnO and BaO;

said conductive paste including a binding material; and said binding material including at least one oxide selected from the group consisting of $SiO_2$, $B_2O_3$, $Na_2O$, PbO, ZnO, $TiO_2$, $K_2O$ and BaO.

23. A chip-type ceramic element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first layer contacting said ceramic body;

said means for electrically connecting including openings in said insulating layer produced by reaction of said insulating layer with said baked electrode layer;

said first layer being a baked electrode layer, wherein said baked electrode layer is a burned combination of said insulating material and a conductive paste;

said insulating layer including at least 50% by weight $SiO_2$;

a remainder of said insulating layer being at least one oxide selected from the group consisting of $Al_2O_3$, MgO, $ZrO_2$, and $TiO_2$;

said conductive paste including a binding material; and said binding material including at least one oxide selected from the group consisting of $SiO_2$, $B_2O_3$, $Na_2O$, PbO, ZnO, $TiO_2$, $K_2O$ and BaO.

24. A chip-type element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first layer contacting said ceramic body;

said first layer being a baked electrode layer, wherein said baked electrode layer is a burned combination of said insulating material and a conductive paste;

said insulating layer including at least one oxide selected from the group consisting of $SiO_2$, $B_2O_3$, $Na_2O$ PbO, ZnO and BaO;

said conductive paste including a binding material; and said binding material including at least one oxide selected form the group consisting of $SiO_2$, $B_2O_3$, $Na_2O$, PbO, ZnO, $TiO_2$, $K_2O$ and BaO.

25. A chip-type element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first layer contacting said ceramic body; and said first layer being a baked electrode layer, wherein said baked electrode layer is a burned combination of said insulating material and a conductive paste;

a conductive inner electrode on each of said opposing end surfaces;

said insulating layer covering said conductive inner electrode;

said baked electrode layer covering a portion of said insulating layer; and means for electrically connecting said conductive inner electrode to said baked electrode layer;

said means for electrically connecting including openings in said insulating layer produced by reaction of said insulating layer with said baked electrode layer.

26. A chip-type ceramic element comprising;

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first layer contacting said ceramic body; and said first layer being a baked electrode layer, wherein said baked electrode layer is a burned combination of said insulating material and a conductive paste, and wherein a melting point of said insulating layer is higher than a temperature used to form said baked electrode layer.

27. A chip-type ceramic element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a baked electrode layer;

at least a portion of said baked electrode being a baked combination of said insulating material and a conductive paste; and said conductive paste being a combination of a metal powder and an inorganic binding material.

28. chip-type element according to claim 27, further comprising:

a plating electrode on each said terminal electrode; and said plating electrode including a layer of nickel and a layer of tin.

29. A chip-type ceramic element comprising:

a conductive ceramic body having opposing end surfaces;

a terminal electrode covering each of said opposing end surfaces;

an insulating layer made from an inorganic insulating material;

said insulating layer covering at least a portion of said ceramic body;

each said terminal electrode including a first inner electrode layer;

each said terminal electrode including a second baked electrode layer;

said baked electrode layer being a baked combination of said insulating material and a conductive paste; and said conductive paste being a combination of a metal powder and an inorganic binding material.

30. A chip-type element according to claim 29, wherein said inner electrode does not overlap peripheral surfaces of said ceramic body.

31. A chip-type element according to claim 30, further comprising:

an plating electrode on each said terminal electrode; and said plating electrode including a layer of nickel and layer of tin.

32. A chip-type element according to claim 25, wherein said inner electrode does overlap said edge on to said ceramic body.

33. A chip-type element according to claim 32, further comprising:

said inner electrode layer including a first wrapping area;

said baked electrode layer including a second wrapping area; and said second wrapping area being smaller than first wrapping area.

34. A method of producing a chip-type element comprising:

burning a chip to produce a ceramic body;

covering at least peripheral sides of said ceramic body with an insulating material;

applying a conductive paste to a wrapping portion of said insulating material at opposing end surfaces of said body; and reacting said conductive paste with said insulating layer to form an electrode in electrical contact with each said portion.

35. A method for producing a chip-type element according to claim 34 further comprising:

plating a first layer of nickel on said electrode; and plating a second layer of tin on said layer of nickel.

36. A method for producing a chip-type element according to claim 34, wherein, following said step of burning, the method further includes placing a conductive metal on each of said opposing end surfaces of said ceramic body.

37. A method for producing a chip-type element according to claim 34, wherein said step of covering includes sputtering.

38. A method for producing a chip-type element according to claim 34, wherein said step of covering includes physical vapor deposition.

* * * * *